United States Patent [19]

Dion-Biro

[11] 4,183,410

[45] Jan. 15, 1980

[54] FIRE-FIGHTING NOZZLE ASSEMBLY HAVING TWO DISCHARGE CONDUITS

[76] Inventor: Guy Dion-Biro, 4600 au du Chateau, 94300 Vincennes, France

[21] Appl. No.: 873,490

[22] Filed: Jan. 30, 1978

[30] Foreign Application Priority Data

Jan. 28, 1977 [FR] France ..... 77 02371

[51] Int. Cl.[2] ..... A62C 31/26

[52] U.S. Cl. ..... 169/25; 239/587; 285/134

[58] Field of Search ..... 239/587; 169/25, 14–16; 285/134, 132, 168, 151

[56] References Cited

U.S. PATENT DOCUMENTS

| | | | |
|---|---|---|---|
| 2,424,969 | 8/1947 | Carpenter | 285/134 |
| 3,567,136 | 3/1971 | Garrett | 239/587 X |
| 3,840,074 | 10/1974 | Clark | 239/587 X |
| 3,989,109 | 11/1976 | Gagliardo | 239/587 X |

*Primary Examiner*—Charles A. Marmor

*Attorney, Agent, or Firm*—Haseltine, Lake & Waters

[57] ABSTRACT

A fire-fighting cannon nozzle assembly comprising two discharge conduits arranged coaxially at a first rotary pivotal position for rotating the assembly about a vertical axis, and which each have a second pivot position along their length where they are not coaxial, for pivotal movement of the discharge ends of the discharge conduits about a horizontal axis.

3 Claims, 2 Drawing Figures

FIRE-FIGHTING NOZZLE ASSEMBLY HAVING TWO DISCHARGE CONDUITS

BACKGROUND OF THE INVENTION

Cannon nozzles are known for projecting a liquid, solid or gaseous fluid, for fighting fire in which liquefied products are burning, such nozzles being mounted on a pivot to permit the cannons or jets of fire-extinguishing substance to be directed in all directions. If two jets of fire-extinguishing substances, such as fluids, are to be projected simultaneously, it is necessary to use two nozzles and therefore two pivots, and in this case two people are required for operating the nozzles; alternatively, if the two nozzles are coupled together in pairs, their range of operating movement is limited and it is impossible to project the fluids over a full range of 360°.

Attempts have been made hitherto to provide nozzle constructions which permit independent movement of the nozzles, for example by mounting the two nozzles on coaxially and totally independent sleeves. However, taking into account mechanical tolerances, with this construction it was then impossible to bring all the nozzles into the proper state of coincidence, to project onto a fire to be extinguished. In addition, the sleeve arrangement often resulted in the components becoming hard to move and even becoming locked, which made it impossible to use the apparatus.

SUMMARY OF THE INVENTION

An object of the present invention is to overcome the above disadvantages, and to provide a nozzle assembly capable of projecting two streams of fire fighting substance. The cannon nozzle according to the invention is constructed for projecting two jets of fire extinguishing agents, simultaneously or otherwise, while permitting a horizontal rotary movement and a vertical movement of the nozzle assembly.

The cannon nozzle assembly according to the invention comprises two discharge conduits which extend parallel to each other but which are independent of each other. Each conduit comprises a smooth bearing and connection sleeve connected to a conduit portion which is bent or curved through an angle approaching 180° (one conduit portion) and through 180° (the other portion). The two conduit portions join together to become coaxial with each other, the conduit portions joining together in a ball-bearing sleeve assembly mounted on a support. On the other side of the support, the conduits are again separated and are each provided with connecting means, such as a flange, for connecting the conduits to feed conduits for supplying fire extinguishing agents to the nozzle assembly.

In the position of use of the nozzle assembly, the smooth sleeves are disposed with their axes horizontal, whereby the nozzle discharge conduits are pivotal in a vertical plane, e.g. independently of each other if required, while the ball bearing sleeve has its axis vertical, to permit the nozzle assembly to rotate in a horizontal plane.

DESCRIPTION OF THE PREFERRED EMBODIMENT

Figure 1:
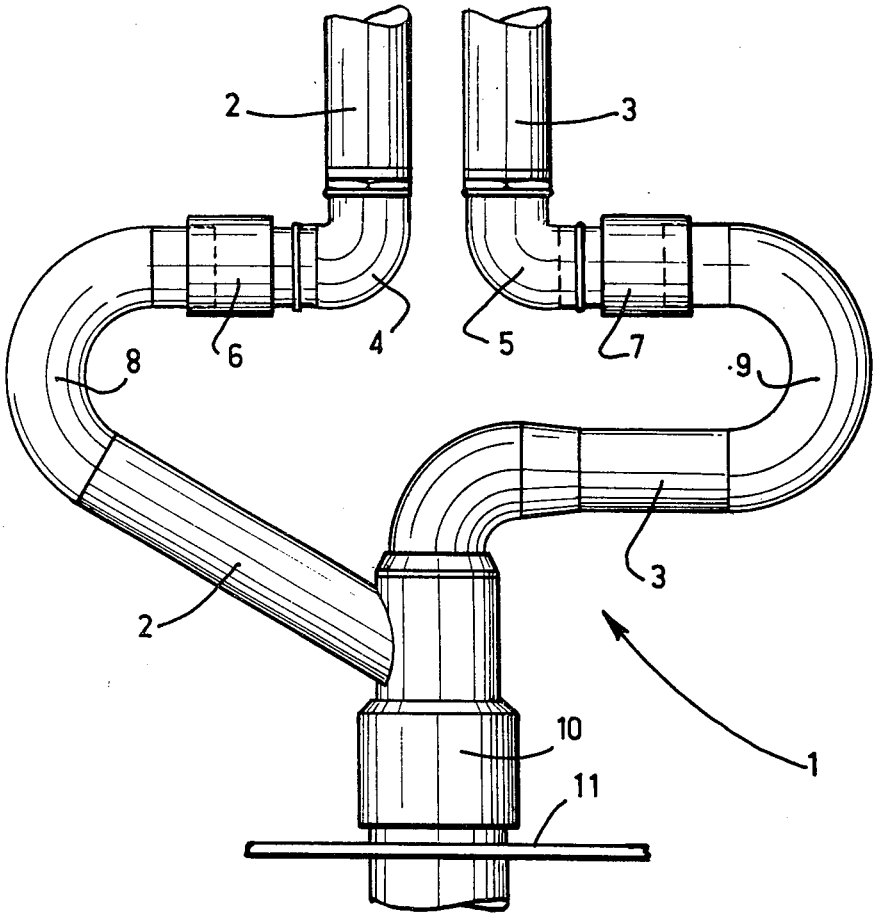
FIG. 1 is an elevational view of a cannon nozzle assembly according to the invention.
Figure 2:
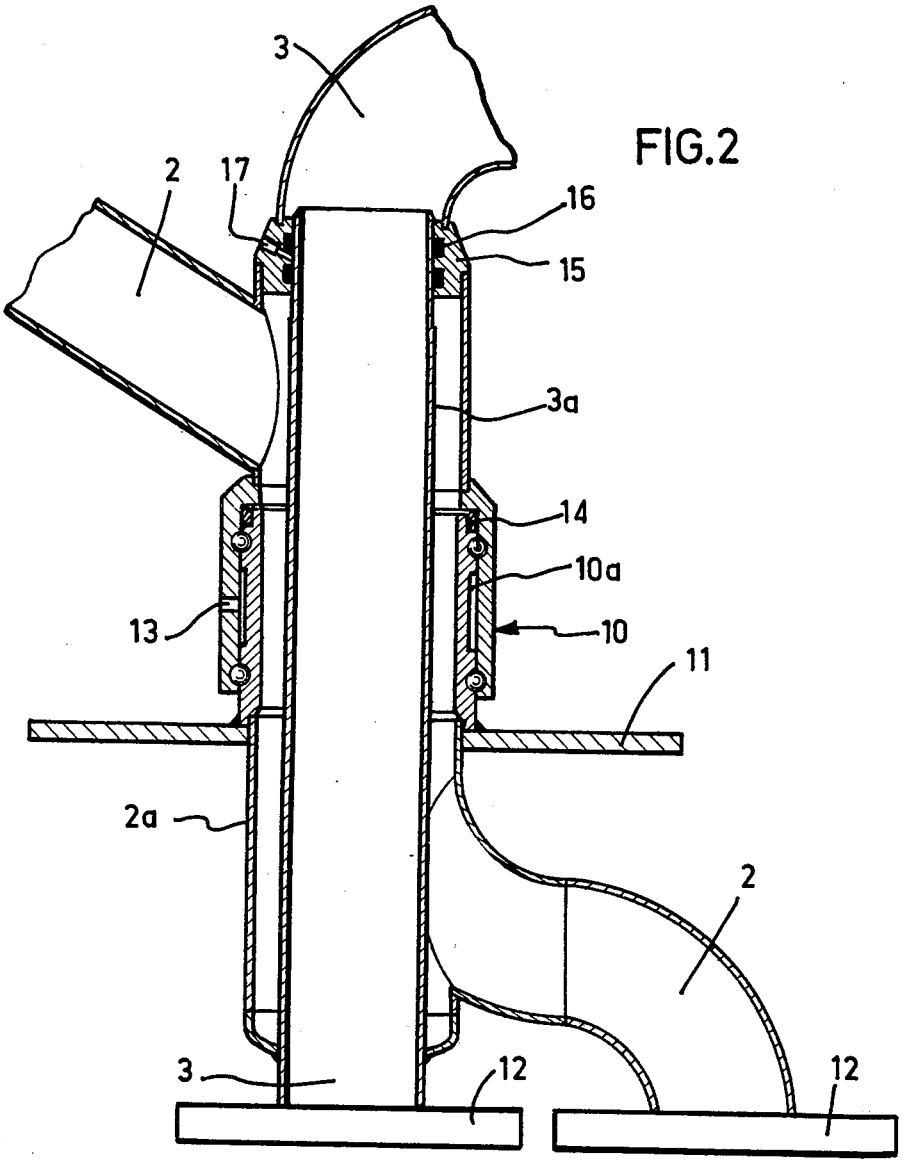
FIG. 2 is a view in cross-section of the ball bearing sleeve of the nozzle assembly of FIG. 1.

Reference is made to FIG. 1 which shows a cannon nozzle assembly 1 comprising two discharge conduits 2 and 3 which extend parallel to each other and each of which is connected to or provided with a 90°-bend elbow member 4 and 5. Each member 4 and 5 is in fluid flow communication with a respective connection sleeve 6 and 7. Each sleeve 6 and 7 is an internally smooth-surfaced sleeve, the smooth internal surface forming a bearing surface to permit the members 4 and 5 to rotate about the axis of the respective sleeve 6 and 7. In use of the assembly, such rotation will generally be in a vertical plane, and may be independent for each conduit 2, 3. Connected to each sleeve 6 and 7 is a respective conduit portion 8 and 9 which each form a 180° curve or bend and then come together and become coaxial within a sleeve assembly 10 mounted on a part of a support 11. The sleeve assembly 10 is in the form of a ball bearing sleeve assembly, and will be described in greater detail with reference to FIG. 2. On the side of the support 11 remote from the sleeve assembly 10, the conduits 2 and 3 separate from each other again and are each provided with connecting means shown as flanges 12 for connecting the conduits to fire extinguishing agent feed conduits for feeding such agents from storage tanks (not shown). The feed conduits may be provided with control valves (not shown).

The sleeve assembly 10 which in use has its axis vertical for permitting rotary movement of the nozzle assembly in a horizontal plane through 360° comprises an inner sleeve part 10*a* which is secured to the support 11 and an outer sleeve part which is rotatably mounted on the part 10*a* by bearing balls or rollers, to carry the forces acting on the sleeve assembly 10. The sleeve assembly 10 has a lubrication means 13, and a seal 14 carried in a collar portion at the upper end of the sleeve assembly 10. The coaxial parts of the conduits are made of welded tubes 2*a* and 3*a*, and the upper end of the tube 3*a* is held and located by a smooth-surfaced bearing sleeve or collar portion 15 provided with seals 16 and a lubrication means 17.

Projection of fire extinguishing agents from the conduits 2 and 3 occurs in a strictly parallel fashion and may be two agents simultaneously or e.g. a single agent alternatively, to suit the convenience of the operator. The cannon nozzle according to the invention is constructed for projecting two jets of fire extinguishing agents, simultaneously or otherwise, while permitting a horizontal rotary movement and a vertical movement of the nozzle assembly. In the illustrated embodiment, the nozzle control action may be effected by means of a lever or by a remote control arrangement, e.g. mechanically, hydraulically, or pneumatically.

Various modifications may be made without departing from the scope of the invention as defined by the appended claims.

What is claimed is:

1. A fire-fighting cannon nozzle assembly for simultaneous discharge of two fire fighting agents in any direction, said assembly comprising a stationary first conduit member for the input of a first fire extinguishing agent, a sleeve assembly rotatably and sealingly assembled with said first conduit member and forming therewith a bearing for rotation of the sleeve assembly about a vertical axis, a second conduit member for the input of a second extinguishing agent, said second conduit member extending coaxially with said first conduit member in spaced relation therewith in said sleeve assembly whereby the agents flowing in the respective conduit members do not intermingle within the rotatable sleeve assembly, a first nozzle discharge conduit means in fluid connection with said first conduit member for delivery of said first extinguishing agent, a second nozzle discharge conduit means in fluid connection with said second conduit member for delivery of said second extinguishing agent, said first and second nozzle discharge conduit means including respective end portions extending in parallel side by side relation and respective further portions forming separate non-coaxial fluid conduits, said further portions including curved parts and rotary sleeve members in the respective said further portions, said rotary sleeve members having axes substantially aligned with each other and extending perpendicular to the axis of rotation of said sleeve assembly to enable the end portions of said discharge conduit means to rotate separately or simultaneously in parallel vertical planes, said cannon nozzle assembly further comprising a support member on which said sleeve assembly is mounted and through which said first and second conduit members pass coaxially, said sleeve assembly having an inner sleeve part fixed to said support member and assembled with said first conduit member, an outer part disposed coaxially with said inner sleeve part and assembled with said first nozzle discharge cnduit means, ball bearings disposed between said inner and outer sleeve parts, and an upper bearing sleeve portion provided with seals and lubrication means, said upper bearing sleeve portion supporting said second nozzle discharge conduit means and an end portion of said second conduit member entering said second discharge conduit means.

2. An assembly as claimed in claim 1 wherein said further portion of said first nozzle discharge conduit means includes a portion extending obliquely from said outer sleeve part and joined to said curved part in said further portion.

3. An assembly as claimed in claim 2 wherein said upper bearing sleeve portion supports said end portion of said second conduit member and said discharge conduit means in coaxial relation.

* * * * *